US007021607B1

(12) United States Patent
Alexander

(10) Patent No.: US 7,021,607 B1
(45) Date of Patent: Apr. 4, 2006

(54) FENCE CONSTRUCTION SYSTEM

(76) Inventor: James Alexander, 606 Bois D ARC, Lockhart, TX (US) 78644

( * ) Notice: Subject to any disclaimer, the term of this patent is extended or adjusted under 35 U.S.C. 154(b) by 0 days.

(21) Appl. No.: 10/248,066

(22) Filed: Dec. 13, 2002

Related U.S. Application Data

(60) Provisional application No. 60/319,033, filed on Dec. 15, 2001.

(51) Int. Cl.
*E04H 17/00* (2006.01)

(52) U.S. Cl. ..... 256/65.11; 256/59; 256/68; 256/70; 256/65.02; 256/65.12

(58) Field of Classification Search ..... 256/1, 256/19, 21, 22, 59, 66, 68, 70, 65.01, 65.02, 256/65.03, 65.08, 65.09, 65.11, 65.12
See application file for complete search history.

(56) References Cited

U.S. PATENT DOCUMENTS

| | | | | |
|---|---|---|---|---|
| 4,014,520 A * | 3/1977 | Walters | ..... | 256/22 |
| 4,403,767 A * | 9/1983 | Basey | ..... | 256/66 |
| 4,898,365 A * | 2/1990 | Conner et al. | ..... | 256/65.12 |
| 5,649,688 A * | 7/1997 | Baker | ..... | 256/21 |
| 5,873,564 A * | 2/1999 | Bisch | ..... | 256/65.12 |

* cited by examiner

*Primary Examiner*—Daniel P. Stodola
*Assistant Examiner*—Michael P. Ferguson
(74) *Attorney, Agent, or Firm*—Daniel N. Lundeen; Lundeen & Dickinson, LLP

(57) ABSTRACT

A fence construction system comprises a clip attached securely to a picket of a fence. The picket is inserted in a hole of a rail and the clip secures the picket to the rail, without field welding.

18 Claims, 6 Drawing Sheets

FENCE CONSTRUCTION SYSTEM

CROSS REFERENCE TO RELATED APPLICATIONS

The present application claims priority from U.S. Provisional Application 60/319,033, filed Dec. 15, 2001 by Alexander, hereby incorporated herein by reference.

BACKGROUND OF INVENTION

This invention relates to fence construction and, more particularly, to a system and method for connecting portions of a fence.

A steel fence is constructed from tubes made from sheets of steel, formed into hollow, elongated tubes, then welded at the connection points. The tubes are used as posts, rails and pickets that are attached, typically, by welding.

Because it can rust easily, the steel is typically treated in some manner. Some steel fences are painted after construction, others are powder-coated with an epoxy material, then baked, to seal in the material, minimizing the opportunity for rusting to occur.

Steel fences are rarely constructed entirely on-site. The fences can be welded into particularly sized panels and treated, such as by powder-coating. The panels are then sent to the installation site, where they are bolted together, avoiding welding that would damage the coating.

Or, the fences can be welded as panels, but not treated, at the factory. Once they are transported to the installation site, the panels are welded together, then painted on-site.

The size of the panels limits the available means of transporting steel fence to a customer. The panels are typically eight feet long or more. Typically, fences are transported to a customer using flat-bed trucks, which is costly.

One solution obviates the need to transport fence panels to an installation site. The fence parts, i.e., posts, rails, pickets and hardware, are transported to the site, then connected together using an internal retaining rod. Each fence part includes holes for receiving the retaining rod. At the installation site, the retaining rod is looped through each fence part along a channel in the rail. The retaining rod is then secured to a fence post by a bracket. In some cases, the retaining rod and/or the open side of the channel are visible, which may be unappealing.

By using the internal retaining rod to connect fence parts, the parts can be sent to the site individually in easily manageable bundles. Further, the fence parts can be powder-coated before being sent, since no welding is performed. However, installation of the fence using the retaining rod can be both complicated and difficult.

Thus, there is a need to produce a fence that can be transported to an installation site unconstructed and that is easy to install on-site.

SUMMARY OF INVENTION

According to one embodiment, a fence system is disclosed comprising a picket, a rail comprising a hole for receiving the picket, and a clip. The clip is securely attached to the picket, wherein the clip is engageable through the hole of the rail. The clip securely couples the picket to the rail.

In a second embodiment, a method for affixing a picket to a rail such that the picket and rail are permanently engaged is disclosed in which a clip is coupled to the picket, the clip comprising a shaped ribbon. The picket is engaged through a hole of the clip such that the clip is not visible.

Advantages and other features of the invention will become apparent from the following description, the drawings, and the claims.

DETAILED DESCRIPTION

In accordance with the embodiments described herein, a fence construction system is disclosed in which a clip is attached securely to a picket of a fence. The picket is inserted in a hole of a rail, and the clip secures the picket to the rail, obviating the need to weld the fence parts together. The configuration permits unconnected fence parts to be shipped to a customer and configured on-site. The fence parts are preferably electrogalvanized and/or powder-coated.

Figure 1:
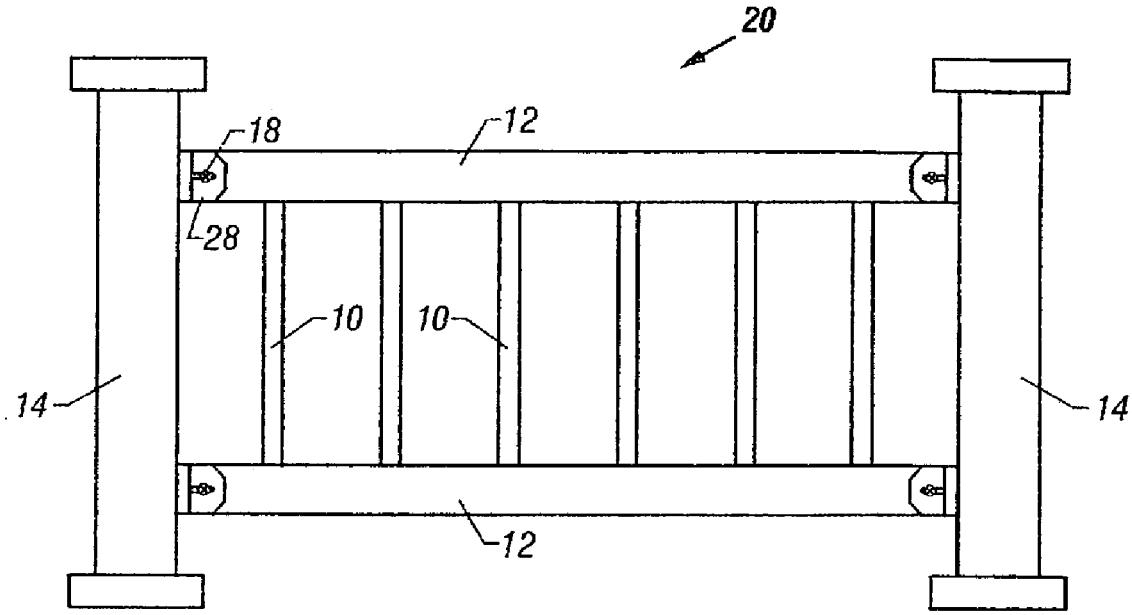
FIG. 1 is a diagram of a fence according to one embodiment of the invention.

In FIG. 1, a fence 20 is depicted, according to one embodiment of the invention. The fence 20 comprises spaced-apart upright posts 14 (or similar supports), coupled to a pair of rails 12 between adjacent posts 14. The posts 14 provide vertical support and are typically recessed in a cement-filled hole in the ground during installation, as is well-known in the art. The rails 12 provide horizontal support to the fence 20. In between the rails 12, a plurality of pickets 10 is shown.

Figure 7:
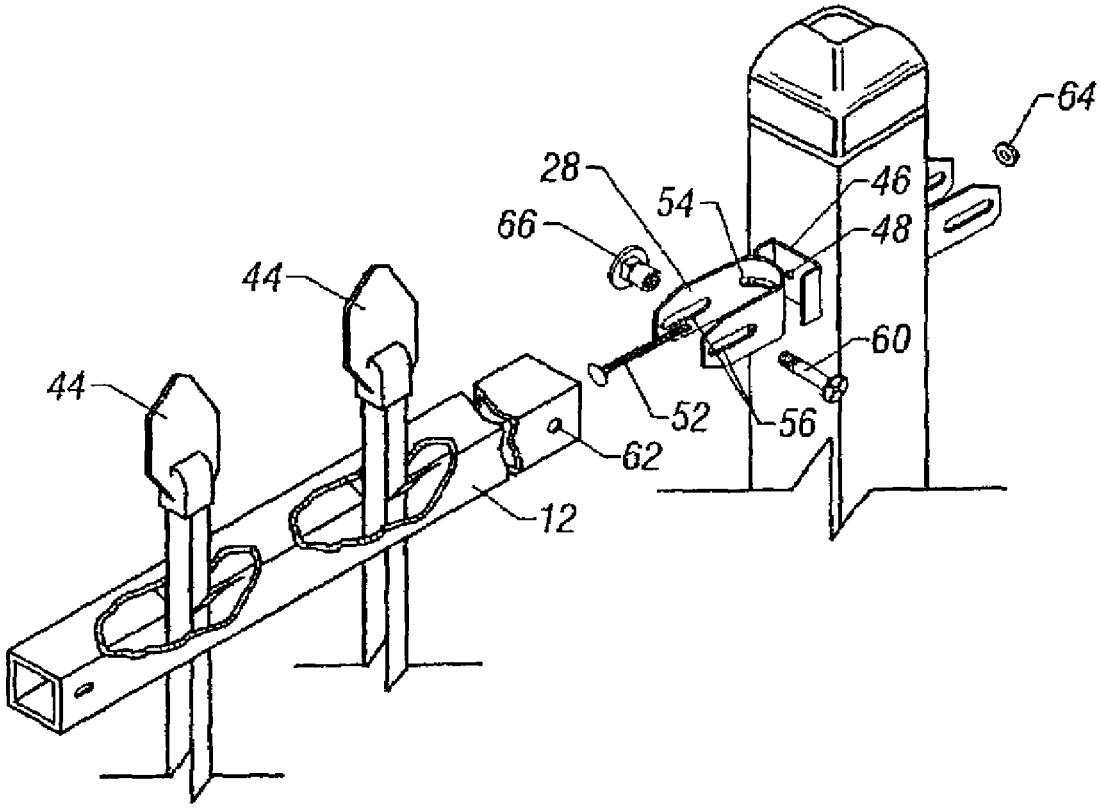
FIG. 7 is a perspective, exploded view showing a typical attachment of the rail to a post according to one embodiment of the invention.

The rails 12 and posts 14 can be connected in any conventional manner, preferably bolted together at some connection points. In FIGS. 1 and 7, for example, the rail 12 is coupled to the post 14 using a bolt 18 and a bracket 28. The bolt 18 and bracket 28 preferably permit movement of the rail relative to the post, such as when the fence is installed on a hill or the post is at a corner. On a flat surface, the rail is generally perpendicular to the post.

According to one embodiment, a clip coupled to the picket 10 engages to the rail 12 such that a stable, permanent connection is made. This enables the fence parts, e.g., the pickets 10, the rails 12, and the posts 14, to be shipped to the installation site, not pre-configured, as described above, but individually or as a convenient bundle. Instead of being shipped as pre-constructed panels, the pickets and rails, as well as the posts, can be shipped in smaller packages or bundles. For example, each bundle can include pickets and rails to construct one panel, with or without a post, and can optionally include post-rail connecting hardware, such as brackets and bolts.

Figure 2A:
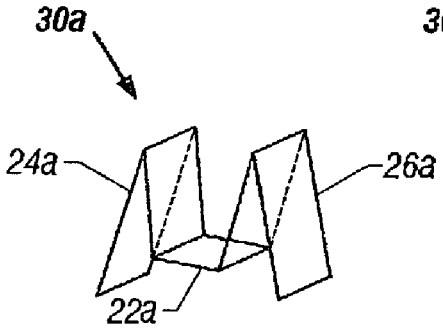
FIGS. 2A–2C are perspective views of alternative embodiments of a clip used to secure a fence.
Figure 2B:
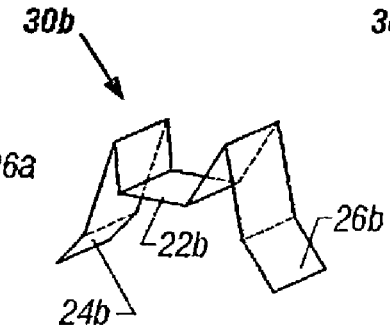
Figure 2C:
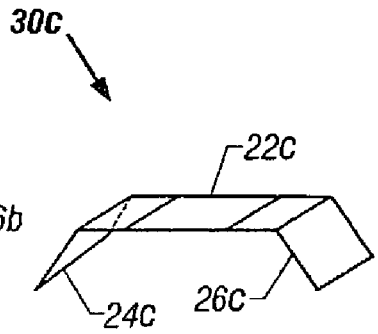

Three clips 30*a*–30*c* are depicted in FIGS. 2A–2C, respectively. Each clip 30 comprises a retention element 22 and two retractable arms, a left retractable arm 24 and a right retractable arm 26. The retractable arms 24, 26 extend angularly away from the retention element 22 and have a length matching the internal dimension of the rail 12 with which the clip 30 is to be used.

In one embodiment, the clip 30 is made from a single ribbon of a strong, but somewhat bendable material, such as steel, preferably 316 stainless steel, to inhibit corrosion. The clips 30 are conventionally formed by cutting and stamping the ribbon.

In a first embodiment (FIG. 2A), the retention element 22*a* of the clip 30*a* is almost as long as the retractable arms 24*b*, 26*b*. The retractable arms are straight, with no additional bending. In a second embodiment (FIG. 2B), the retention element 22*b* of the clip 30*b* is somewhat shorter than the retractable arms 24*b*, 26*b*. Further, the retractable arms 24*b*, 26*b* are creased such that the arms bend further away from the retention element than with clip 30*a*.

Figure 3:
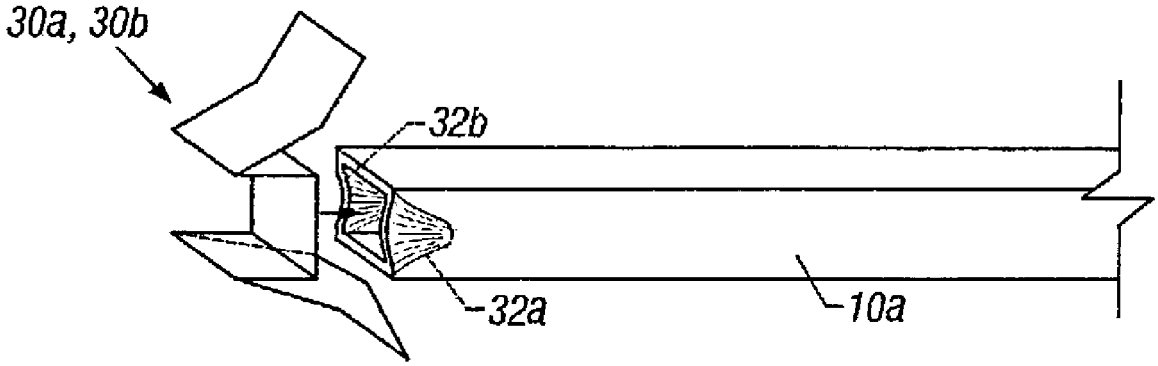
FIG. 3 is a perspective view of the clip of FIG. 2A or FIG. 2B coupled to an end of a picket according to one embodiment of the invention.

The clips 30*a* or 30*b* are affixed to the pickets 10 at one or both ends. The connection of clip 30*a* or 30*b* to a picket 10*a* is depicted in FIG. 3. The retention element is shaped to fit easily or snugly inside the hollow end of the picket 10*a*, as shown. The retractable arms 24, 26 extend outward, on either side of the retention element 22 and picket 10.

The clip 30*a* (30*b*) is connected to the picket 10*a* at the factory, in one embodiment. After being affixed to the end of the picket, two end dimples, a left dimple 32*a* and a right dimple 32*b*, are made in the two sides of the picket 10*a* that are transverse to the retractable arms of the clip. The dimples are depressions of the metal of the picket formed by mechanical stamping. Although the clip 30 may seat tightly into the end of the picket 10 when coupled thereto, the dimples 32 provide extra assurance that the clip 30 will not uncouple from the picket.

Clips 30*a* and 30*b* represent two configurations suitable for engagement with the picket end. However, various changes to the clips can be made. For example, the retention element 22 can be a solid cubic block of material, such as plastic, with retractable arms extending therefrom, rather than a ribbon of malleable material. The clip can be made using plastic or other elastomeric material, aluminum, copper, tin, or other alloys, or be composed of a composite material. Further, the retention element need not be square, but can be circular, oblong, or irregular in shape, preferably matching the cross-sectional shape of the picket.

Turning to FIG. 2C, in a third embodiment, the retention element 22 of the clip 30*c* is generally flat between retractable arms 24*c*, 26*c*. These retractable arms 24*c*, 26*c* are somewhat similar to those of clip 30*a*.

Figure 4A:
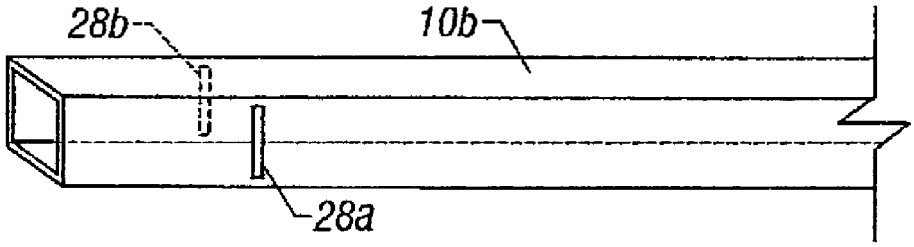
FIGS. 4A and 4B are perspective views of the clip of FIG. 2C coupled to a picket according to one embodiment of the invention.
Figure 4B:
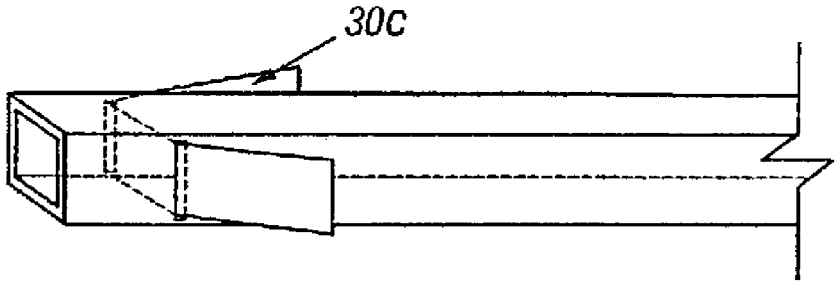

Clip 30*c* is preferably used in spaced relation to an end of the picket 10*b*. As depicted in FIGS. 4A and 4B, two slits 28*a* and 28*b* are created on the picket 10*b* for receiving the clip 30*c*. The slits 28 are on opposite sides of the picket and are preferably stamped into a metal sheet during manufacture of the picket 10*b*, before forming the sheet into a tube. The metal ribbon of the clip 30*c* is inserted through both slits 28 and bent at the protruding ends, taking care to obtain arms 24*c*, 26*c* of equal length. The retractable arms 24*c*, 26*c* are present on opposite sides of the picket 10*b*.

Figure 5A:
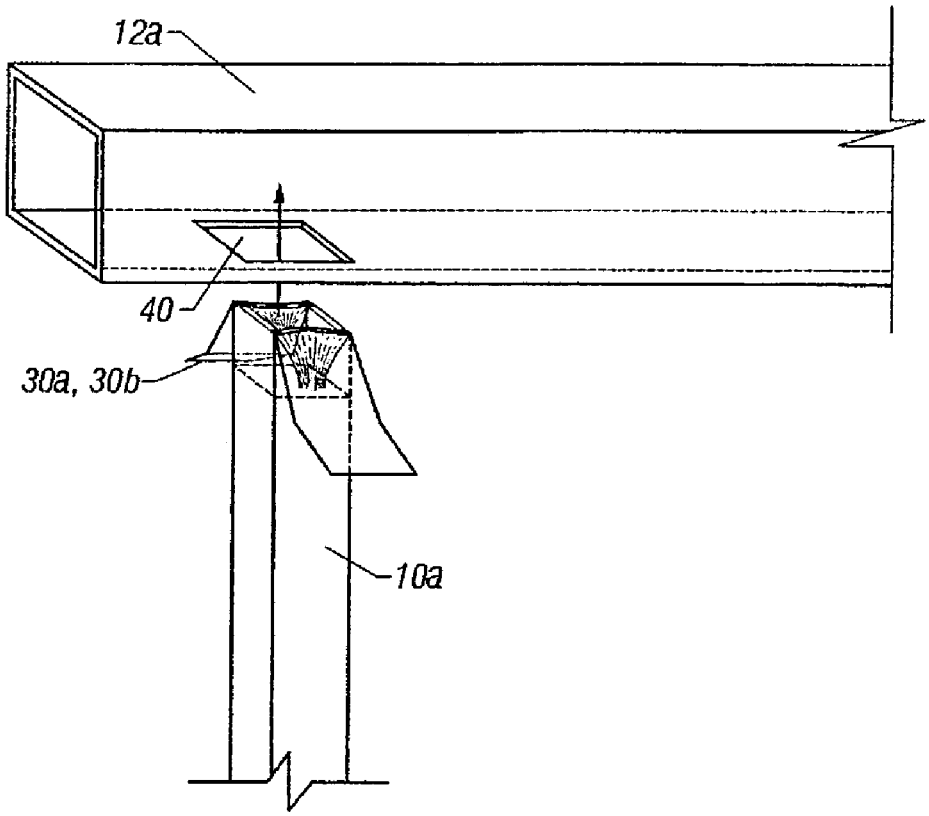
FIGS. 5A and 5B are perspective views of a picket with an engaged clip (FIG. 2A or 2B) being coupled to a rail according to one embodiment of the invention.
Figure 5B:
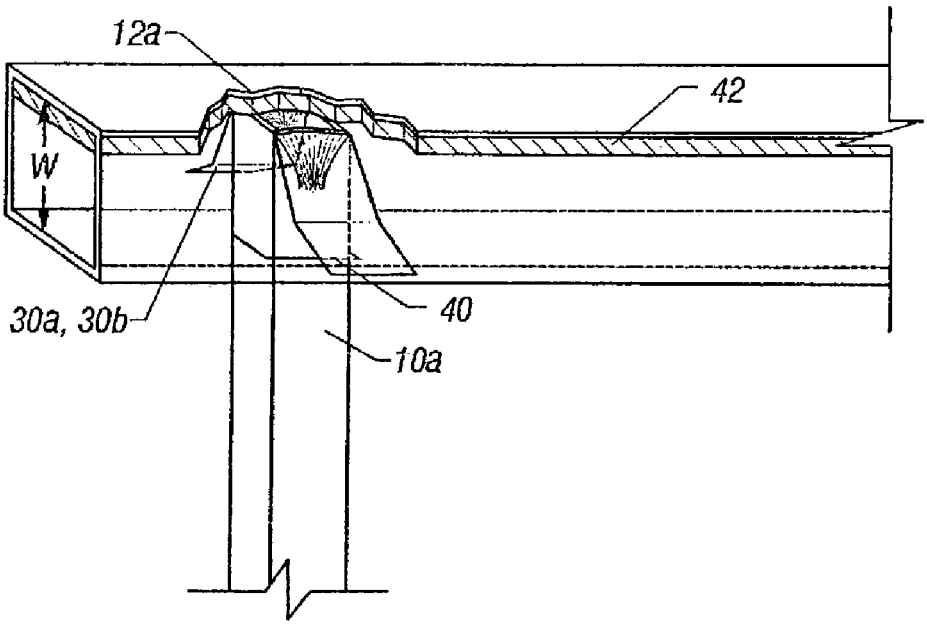

In FIGS. 5A and 5B, according to one embodiment, one of the clips (30*a* or 30*b*) is shown engaged to an end of picket 10*a*. The rail 12*a* to which the picket 10*a* is to be engaged includes a hole 40 for receiving the picket. The rail 12 is typically made by shaping sheets of metal into squared tubes, then welding the longitudinal edges together, as is well known in the art. The holes 40 are conventionally formed in the metal sheet, e.g., by cutting or stamping, before the sheet is formed into the tubular shape and welded closed.

The picket 10*a* has an end with a cross-section dimensioned so as to be insertable into the hole 40, i.e. the exterior dimensions of the picket 10*a* match the dimensions of the hole 40 with sufficient clearance for the arms 24,26. The arms 24, 26 of the clip 30*a* (30*b*) are retractable. As the end of the picket 10*a* is inserted into the hole 40, the arms 24, 26 are pressed against the contours of the hole 40. After passing the ends of the clip 30*a* (30*b*) through the hole 40, the retractable arms 24,26 are spring-biased and return to their original position, angularly extended outward from the retention element 22, preventing the picket from being retracted from the hole. Thus, the picket 10*a* is slideably engaged with the rail 12*a*.

Once the picket 10*a* is sufficiently fed into the hole 40, the retractable arms 24, 26 have memory and will return to their original positions, as shown in FIG. 5B. The arms 24, 26 move back to an outward position, relative to the retention element 22. Further, in one embodiment, the retractable arms 24, 26 are flush against the vertical sides of the rail 12*a*, as shown in FIG. 5B. The outward movement effectively prevents the picket 10*a* from being removed from the rail 12*a*. In one embodiment, the length of retraction arms 24, 26 is approximately the same as the internal dimensions of the rail 12, as shown by the line W in FIG. 5B.

In one embodiment, a foam insert 42 is positioned at the top inside surface of the rail 12*a*, as shown. Although the picket 10*a* is to be engaged with the rail 12*a* for a snug fit within the rail 12, the additional padding of the foam insert 42 can be used to further snug the picket into the rail. The foam insert 42 can be made of polyethylene, polystyrene, or other light-weight material. The foam insert 42 can be installed in the rail 12, for example with an adhesive, at the factory or can be installed on-site.

Figure 6A:
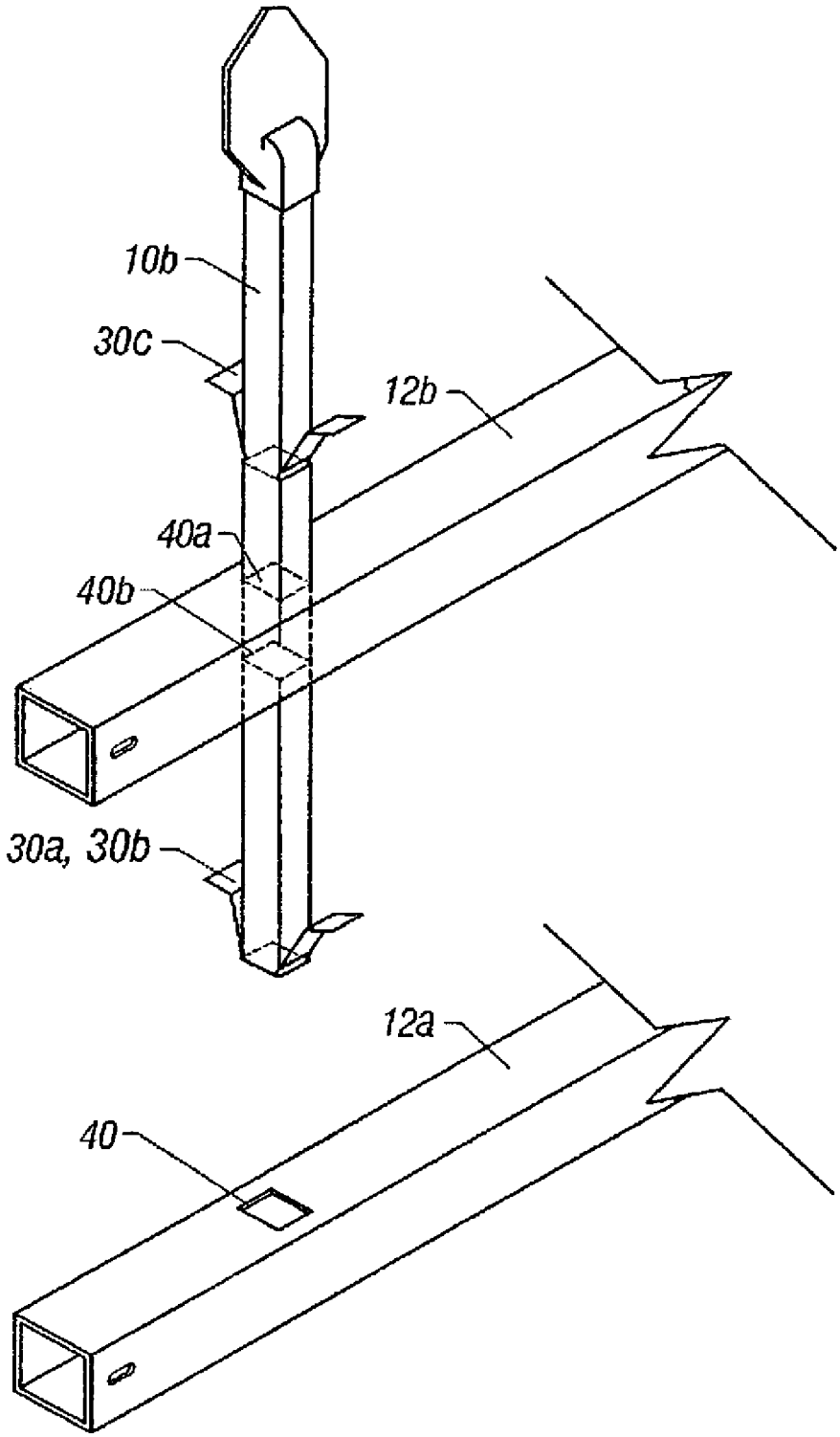
FIGS. 6A and 6B are perspective views of a picket with an engaged clip (FIG. 2C) being coupled to a rail according to one embodiment of the invention.
Figure 6B:
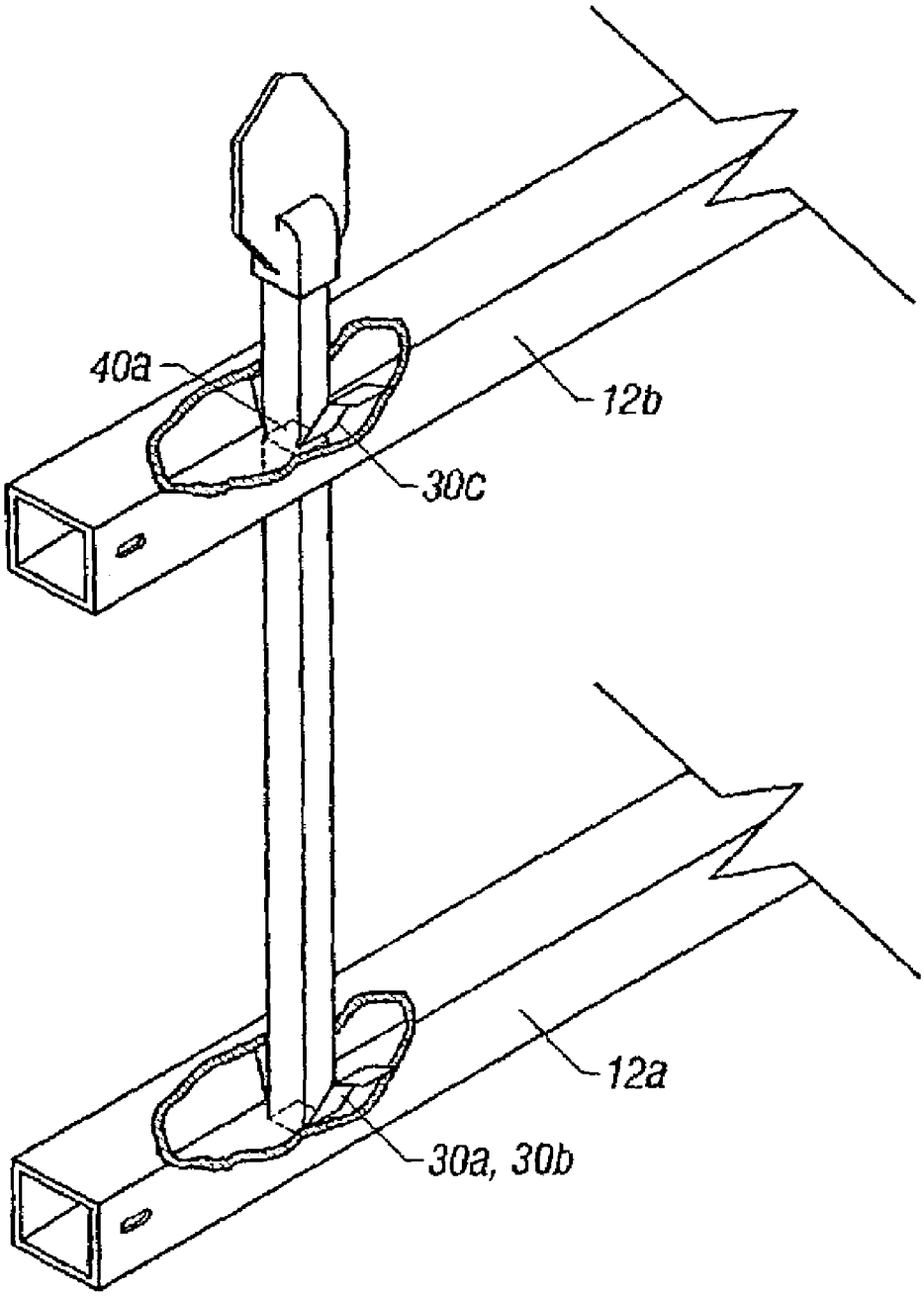

FIGS. 6A and 6B show how clip 30*c* can be used to engage a picket 10*b* to a rail 12*b*. While the picket 10*b* includes a clip 30*a* (30*b*) engaged to one end, the picket 10*b* also includes slits 28 (see FIG. 4A) for receiving a second clip 30*c*. Two rails 12 are depicted. The bottom rail 12*a* is a single-hole rail, as in FIGS. 5A and 5B. The top rail 12*b* is a dual-hole. The rail 12*b* includes two opposing holes 40*a* and 40*b*, each stamped through opposite sides of the rail 12*b*. The holes 40 allow the picket 10*b* to be engaged, not just against one end of the rail, but entirely through the rail 12*b*.

Accordingly, in FIG. 6A, the picket 10*b* has already been engaged through the dual-hole rail 12*b*. The picket 10*b* fits into the first hole 40*a* and slides through the rail 12*b*, out through the second hole 40*b*. During insertion, the end clip 30*a* (30*b*) is held flush against the picket so that it can slide through the hole of the top (two-hole) rail 12*b*.

During the sliding operation, the clip 30*c* reaches the top rail 12*b* at approximately the same time as the clip 30*a* (30*b*) reaches the bottom rail 12*a*. The retractable arms 24*c*, 26*c* can be held against the picket, allowing the clip 30*c* to slide through the first hole 40*a* of the top rail 12*b*. Likewise, the retractable arms 24*a*, 26*a* (24*b*, 26*b*) can be held against the picket, allowing the clip 30*a* (30*b*) to slide through the hole 40 of the bottom rail 12*a*.

After sliding through their respective holes, the retractable arms of each clip return to their original positions, extending laterally from opposite sides of the picket 10*b*, as shown in FIG. 6B. Because of the clips, the picket 10*b* cannot be slid back in the direction from which it was inserted into the rail 12*b*.

In one embodiment, an ornamental cap 44 is inserted onto the end of the picket 10*b*, above the rail 12, as shown. Preferably, the ornamental cap 44 has a tapered inside dimension, so as to be hammered or otherwise friction-fit onto the protruding end of the picket 10*b*. By installing the picket 10*b* in the manner shown in FIGS. 6A and 6B, the ornamental cap 44 can be pre-installed on the picket (e.g., at the factory) rather than being secured upon the picket at the installation site.

The arrangements described in FIGS. 5A and 5B are not mutually exclusive from the arrangements described in FIGS. 6A and 6B. For example, and end-coupling clip (30*a* or 30*b*) can be used with the dual-hole rail 12*b* where one hole 40*a* (40*b*) of the dual-hole rail 12*b* is actually blocked by the retention element 22*a* (22*b*) of the clip 30*a* (30*b*). Or, the slit-engaged clip (30*c*) can be used with the single-hole rail 12*a* where the slits 28 are sufficiently close to an end of the picket that the clip 30 fits into the rail space. For example, where the slits are positioned a distance less than the internal dimension of the rail (W in FIG. 5B) from the end of the picket, the clip 30*c* can be used to engage picket 10*b* to a single-hole rail 12*a*.

The fence of FIG. 1 can be constructed by first installing the posts 14, such as by recessing in a cement hole. In one embodiment, the lower rail 12 is then bolted to both left and right posts, using brackets 28 and bolts 18. The plurality of pickets 10 are next inserted into the lower rail 12, using clips as described above. The upper rail next is secured to each of the pickets. Finally, the upper rail is bolted to the left and right posts. Where the pickets extend through the upper rail, the ornamental caps 44 are connected to the top of the pickets. Alternatively, a panel comprising the upper and lower rails and each of the pickets can be made and then bolted to the posts 14.

In FIG. 7, an exploded perspective view shows how the rail is connected to the post, according to one embodiment. A post connector 46 is affixed to the post 14. The post connector is a metal sheet, bent at its ends, and including a center hole 48 for receiving a bolt 52. A first groove 54 in the bracket 28 receives the bolt 52, for connection to the post connector. The first groove 54 permits the bracket to be laterally moved before the bolt is tightened into the post connector 46. The bolt 52 is tightened through the bracket 28, the post connector 46, and into the post 14 before the rail 12 is engaged with the bracket. A nut 64 engages the bolt 52 to the rail 12. The bolt 52 and the nut 64 can engage a second post connector on the other side of the post 14 (not shown).

The rail 12 is slidably inserted into the bracket, as shown. The bracket 28 includes lateral grooves 56. The end of the rail 12 includes a hole 62. Once the rail 12 is seated in the bracket 28, a bolt 60 can be inserted through the lateral grooves 56 and the hole 62, and secured by a nut 66. The lateral grooves 56 allow the rail 12 to be installed flush against the post 14, a distance away from the post 14 (equal to the length of the lateral grooves 56), or some distance in between.

While the invention has been described with respect to a limited number of embodiments, those skilled in the art will appreciate numerous modifications and variations therefrom. It is intended that the appended claims cover all such modifications and variations as fall within the true spirit and scope of the invention.

What is claimed is:

1. A fence section to be installed between a pair of supports, the fence section comprising:

at least one rail, said rail configured to extend between the supports;

said rail having at least one receptacle along its length, said receptacle configured to insertably receive a picket;

said picket having an outer profile and said picket including a unitary retention clip, said retention clip having a retention element and at least two retractable self engaging arms, wherein said retention element is engaged within the end of said picket;

said retractable arms configured to retract during insertion of the picket into the receptacle, and wherein said retractable arms are spring-biased to extend and engage said rail when said picket is disposed within said receptacle, thereby securing said picket within said rail; and, wherein said rail further comprises a foam insert proximate said receptacle, said foam insert configured to bias and retain said picket when said retractable arms engage said rail.

2. The fence section of claim 1 wherein said receptacle corresponds to said outer profile of said picket and said retractable arms when said retractable arms are retracted.

3. The fence section of claim 1 wherein said outer profile is selected from the group consisting of circles, squares, diamonds, hexagons, and ellipses.

4. The fence section of claim 1 wherein said retention clip is secured at the end of said picket.

5. The fence section of claim 1 wherein said picket is dimpled at its end to retain said retention element.

6. The fence section of claim 1 wherein said retention element corresponds to an inner profile of said picket.

7. The fence section of claim 6 wherein said retention element is generally rectangular-shaped.

8. The fence section of claim 1 wherein said retention clip is manufactured of a pliable ribbon material.

9. The fence section of claim 8 wherein said pliable ribbon material is manufactured of a material selected from the group consisting of steel, stainless steel, aluminum, copper, tin, plastic, elastomer, and composite materials.

10. A fence section to be installed between a pair of supports, the fence section comprising at least one rail configured to extend between the supports;

the rail having at least one receptacle along its length, the receptacle configured to insertably receive a picket;

the picket having an outer profile, and the picket including a unitary retention clip having a retention element and at least one retractable arm;

the retractable arm configured to extend and engage the rail when the picket is disposed within the receptacle, thereby securing the picket within the rail; and a foam insert proximate the receptacle configured to bias and retain the picket when the retractable arm engages the rail.

11. The fence section of claim 10 wherein said receptacle corresponds to said outer profile of said picket.

12. The fence section of claim 10 wherein said outer profile is selected from the group consisting of circles, squares, diamonds, hexagons, and ellipses.

13. The fence section of claim 10 wherein said retention clip is secured at the end of said picket.

14. The fence section of claim 13 wherein said retention element is engaged within the end of said picket.

15. The fence section of claim 14 wherein said picket is dimpled at its end to retain said retention element.

16. The fence section of claim 14 wherein said retention element corresponds to an inner profile of said picket.

17. The fence section of claim 10 wherein retention element is manufactured of a pliable ribbon material.

18. The fence section of claim 17 wherein said pliable ribbon material is manufactured of a material selected from the group consisting of steel, stainless steel, aluminum, copper, tin, plastic, elastomer, and composite materials.

* * * * *